United States Patent [19]

Rammler et al.

[11] Patent Number: 4,466,863

[45] Date of Patent: Aug. 21, 1984

[54] EQUIPMENT FOR DEVOLATILIZING DEVOLATILIZABLE FINE-GRAINED MATERIAL BY MEANS OF HOT FINE-GRAINED HEAT-CARRYING MATERIAL

[75] Inventors: Roland Rammler, Königstein; Alfons Bussmann, Nidderau, both of Fed. Rep. of Germany

[73] Assignee: Metallgesellschaft Aktiengesellschaft, Frankfurt am Main, Fed. Rep. of Germany

[21] Appl. No.: 503,077

[22] Filed: Jun. 13, 1983

Related U.S. Application Data

[63] Continuation of Ser. No. 369,688, Apr. 19, 1982, abandoned, which is a continuation of Ser. No. 206,512, Nov. 13, 1980, abandoned.

[30] Foreign Application Priority Data

Nov. 15, 1979 [DE] Fed. Rep. of Germany ..... 2946102

[51] Int. Cl.[3] ..... C10B 1/08; C10B 49/20; C10B 57/02

[52] U.S. Cl. ..... 202/99; 202/215; 202/265

[58] Field of Search ..... 201/8, 12, 20, 28, 31–34, 201/42; 202/88, 89, 99, 116, 117, 120, 121, 129, 215, 265; 366/336, 337, 107; 406/88, 116, 120, 144, 157

[56] References Cited

U.S. PATENT DOCUMENTS

| | | | |
|---|---|---|---|
| 2,460,605 | 2/1949 | Soissa | 366/336 |
| 2,717,867 | 9/1955 | Jewell et al. | 201/4 |
| 2,983,653 | 5/1961 | Danvlat et al. | 201/33 |
| 3,476,649 | 11/1969 | Ledent | 201/12 |
| 3,655,518 | 4/1972 | Schmalfeld et al. | 201/12 |
| 3,703,442 | 11/1972 | Rammler et al. | 201/12 |
| 3,733,056 | 5/1973 | Fong | 366/107 |
| 4,038,045 | 7/1977 | Rammler et al. | 201/12 |
| 4,211,606 | 7/1980 | Ponomarev et al. | 201/12 |
| 4,324,620 | 4/1982 | Ito et al. | 202/215 |
| 4,344,821 | 8/1982 | Angelo | 201/33 |

FOREIGN PATENT DOCUMENTS 189542 12/1922 United Kingdom .

*Primary Examiner*—Bradley Garris

*Attorney, Agent, or Firm*—Sprung, Horn, Kramer & Woods

[57] ABSTRACT

Devolatilizable fine-grained material which contains hydrocarbons is devolatilized by means of fine-grained solids which have been heated to temperatures of about 500° to 1000° C. The devolatilizable fine-grained material is mixed with the heated solids and is thus heated to temperatures of about 400° to 900° C. The mixture is passed through a dwell zone, and gaseous and vaporous devolatilization products are withdrawn and cooled. The heated solids are fed to the dwell zone as a loosened stream in a trickling and/or agitated state of motion, and the devolatilizable fine-grained material is introduced into said stream in order to be admixed thereto. The heated solids and the devolatilizable fine-grained material can be mixed in a weight ratio of 3:1 to 12:1. The stream of trickling heated solids can be deflected at least in part.

8 Claims, 5 Drawing Figures

EQUIPMENT FOR DEVOLATILIZING DEVOLATILIZABLE FINE-GRAINED MATERIAL BY MEANS OF HOT FINE-GRAINED HEAT-CARRYING MATERIAL

This application is a continuation of application Ser. No. 369,688, filed Apr. 19, 1982, now abandoned which in turn is a continuation of patent application Ser. No. 206,512 filed Nov. 13, 1980, now abandoned.

BACKGROUND OF THE INVENTION

1. Field of the Invention

This invention relates to a process of devolatilizing hydrocarbon-containing devolatilizable fine-grained material by means of fine-grained solids heated to temperatures of about 500° to 1000° C., wherein the fine-grained material is mixed with the heated solids and is thus heated to temperatures of about 400° to 900° C., the mixture is passed through a dwell zone, and gaseous and vaporous devolatilization products are withdrawn and cooled, and to equipment for carrying out the process. The devolatilizable fine-grained material consists mainly of tar sand, oil shale, oil-containing diatomaceous earth and coal. The apparatus can also be used to treat liquid feedstock, e.g., to coke heavy oil.

2. Discussion of the Prior Art

Processes of the type described above are known from German Pat. Nos. 1,809,874; 1,909,263, from German Offenlegungsschrift No. 2,527,852, and from the corresponding U.S. Pat. Nos. 3,655,518; 3,703,442; and 4,038,045. The heated solids are contacted in a mechanical mixer with the material to be devolatilized. The heated solids consist in most cases of residual material which has become available in the devolatilizing process and has been heated to the required temperature by combustion gases in a pneumatic conveyor.

It is an object of the invention to thoroughly mix the heated solids used as heat-carrying material and the material to be devolatilized so that the distillation is effected quickly and completely as is desired. A mechanical mixer is not to be used because this would involve a high structural expenditure comprising moving elements disposed in regions at high temperature.

SUMMARY OF THE INVENTION

In the process described first hereinafter this object is accomplished in that the heated solids are fed as a loosened stream in a trickling and/or agitated state of motion to the dwell zone, and the fine-grained material to be devolatilized is introduced to said stream in order to be admixed therewith. This results in a substantial penetration of the hot heat-carrying particles with the devolatilizable material, which is cold or has been preheated, and the devolatilizable material is thus uniformly heated to the distillation temperature. The process can be performed without aid of a mechanical mixer or moving elements for mixing.

Another advantage resides in that heat is transferred quickly from the heated solids to the fine-grained material so that a degasification is effected quickly and a short dwell time of the hydrocarbon vapors in the devolatilization zone is sufficient. A relatively long dwell time of these vapors in contact with the hot solids might initiate disturbing cracking processes by which the yield of condensible hydrocarbons would be decreased.

It has proved suitable to mix the heated solids and the fine-grained material in a weight ratio of 3:1 to 12:1.

This permits sufficiently high devolatilization temperatures in conjunction with short contact times. For a thorough mixing, the particle sizes of the materials to be mixed should not exceed 8 to 10 mm.

If the heated solids are permitted to trickle downwardly, the loosening and mixing of the solids streams can be improved in that at least part of said streams is deflected. This can be effected in various ways, e.g., by the provision of a suitable trickling path or of obstacles to the flow or by a combination of such measures. The fine-grained material may be distributed first to a plurality of streams which are then supplied to the heated solids which are in a state of motion.

An even better preliminary distribution can be effected in that the heated solids are also loosened by being distributed to a plurality of streams. The interpenetration of the streams of hot and cold fine-grained solids which are in a trickling and/or agitated state of motion can be further promoted in this way. This can also be effected in that the devolatilizable material and the heated solids are fed in superimposed or juxtaposed strata to the zone in which they are in a trickling and/or agitated state of motion.

As the heated solids and the fine-grained material which is fed are mixed, they are usually moved at least in part with horizontal and vertical components of motion. The horizontal motion results in a desired transverse mixing. The vertical component of motion causes the progressively interpenetrating material to flow to the dwell zone. The mixing action can be intensified in that preferably part of the gaseous devolatilization products are fed into the stream of the heated solids and/or the devolatilizable fine-grained material with the aid of entraining gases or agitating gases.

The dwell zone serves mainly to vaporize even difficultly vaporizable components and to effect a retardation of the motion of the fine-grained particles. In addition, that dwell zone can be used also as a buffer zone, which precedes the withdrawal and the further processing of the devolatilized residue.

Part of the devolatilized residue may be transferred to a heating zone and be re-used as heat-carrying fine-grained solids in the process.

The equipment according to the invention used to carry out the process described first hereinbefore comprises at least one trickling and/or agitating passage, which precedes the dwell zone and in which the stream of heated solids and of fine-grained material is caused to interpenetrate. Any trickling passage preceding the dwell zone may contain at least one obstacle to the flow and such obstacle may be adjustable. The trickling passage may have one or more abrupt bends.

Any agitating passage which precedes the dwell zone has suitably a bottom which is approximately horizontal or slopes slightly toward the entrance to the dwell zone. That bottom may be provided with numerous nozzles or inlet slots for the introduction of agitating gas. It will be endeavored to minimize the rate at which agitating gas is required because that gas is withdrawn together with the vapors to be recovered as a product. A trickling passage and an agitating passage may be combined and in this case will be connected in series.

BRIEF DESCRIPTION OF DRAWINGS

Preferred further features of the invention will be explained with reference to the drawing, in which.

DESCRIPTION OF SPECIFIC EMBODIMENTS

Figure 1:
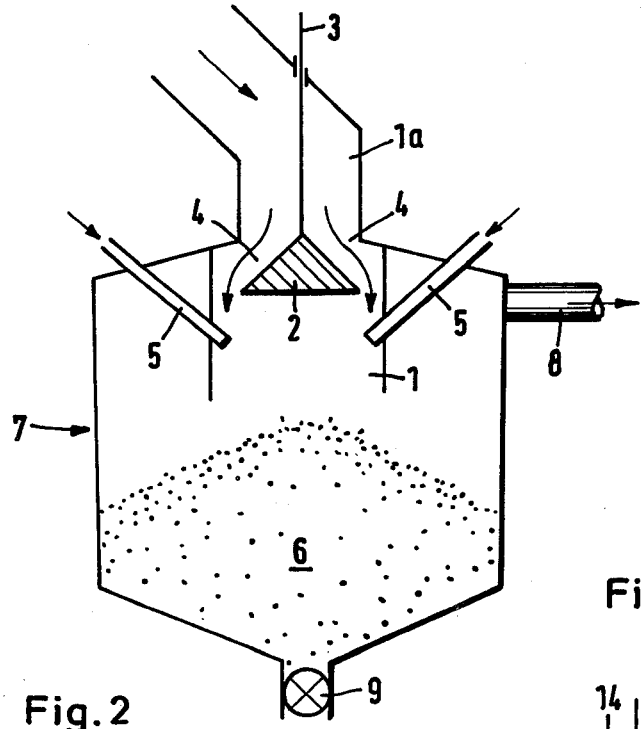
FIG. 1 is a diagrammatic longitudinal sectional view showing a trickling passage and a succeeding dwell zone.

In the embodiments shown in FIG. 1, the heat-carrying solids which have been heated to temperatures of about 500° to 1000° C. fall from a supply bin, not shown, over a distributing cone 2 into a cylindrical trickling passage 1. The distributing cone 2 is secured to a stem 3, by which the cone 2 can be adjusted in height. The distributing cone 2 deflects the falling solids to the side so that a loosened stream results, which resembles a veil. By the adjustment of the cone 2 in height, the width of the gap 4 between the rim of the cone 2 and the trickling passage 1 can be changed. As a result, the thickness, measured in a radical direction, of the stream of particles falling past the cone 2 can be controlled and with it the mass flow rate.

Outlet openings of a plurality of feed conduits 5 for devolatilizable fine-grained material are disposed below the distributing cone 2. That material is also supplied from one or more supply bins, not shown. As devolatilizable material emerging from the conduits 5 enters the heated solids which trickle downwardly, the agitation is increased. The outlet openings of the conduits 5 are disposed within the trickling passage 1, which in this region is slightly larger in diameter than the feed passage 1*a* above the distribution cone 2. The larger diameter is required mainly to provide adequate space for the motion of the agitated and trickling particles so that the interpenetration and mixing of the solids streams can be effected quickly and freely. The mixing of the devolatilizable material and of the heated solids can be improved in that the devolatilizable material can be blown by a suitable entraining fluid (gas or vapor) at exit velocities of 4 to 80 meters/second onto the stream of trickling solids.

The mixture of devolatilizable material from conduits 5 and heated heat-carrying material from the feed passage 1*a* is accumulated in the dwell zone 6 to form a pile. The dwell zone may have such a cross-sectional area that rising vapors and gases evolved during any subsequent degasifying reactions will cause the uppermost layers of the pile to assume a loosened or slightly agitated state. The hydrocarbon-containing vapors are withdrawn through the conduit 8 from the vessel 7, which contains the dwell zone 6 and the lower end of the trickling passage 3, and are then treated in known manner in dust-collecting and condensing equipment, not shown. The solids which accumulate in the dwell zone and contain the devolatilized residue are withdrawn from the lower end of the vessel through a metering device 9. Part of the fine-grained solids which have been withdrawn can be fed to a heater and can then be reused as heat-carrying solids and finally re-fed to the trickling passage 1. The amount of fine-grained solids so recycled can be between about 80 and 96% of the solids withdrawn from the dwell zone 6.

The desired devolatilization temperature in the range of 400° to 900° C. is maintained in the dwell zone. It is readily apparent from FIG. 1 that the overhead vapors which are evolved as a result of the heating of the devolatilizable material supplied through conduit 5 and are desired as a product can be withdrawn through the conduit 8 after a relatively short travel and relatively short dwell time in the vessel 7. A short dwell time of the overhead vapors in the vessel 7 will prevent secondary cracking processes in the overhead vapors; such secondary cracking processes would decrease the yield.

Figure 2:
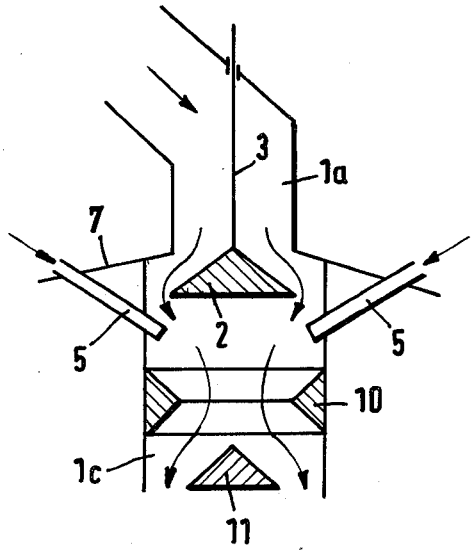
FIG. 2 is a longitudinal sectional view showing a second embodiment of a trickling passage.

FIG. 2 shows a modification of the trickling passage 1 which has been explained with reference to FIG. 1. In accordance with FIG. 2, the trickling passage 1*c* comprises additional deflecting means. These deflecting means comprise a constricting ring 10, which is preferably triangular in cross-section. This constricting ring 10 is disposed below the outlet openings of the conduit 5 for supplying devolatilizable material and retards the downward movement of the trickling solids and increases the possibility of an agitation and of a motion of the particles with a horizontal component over the cross-section of the trickling passage. Such transverse motion will promote a thorough mixing and interpenetration of streams of hot and cold materials.

Below the constriction 10, a displacement cone 11 is centrally disposed in the trickling passage and may alternatively consist of a double cone. The displacement cone 11 imparts an additional transverse motion to the particle. An intense transverse motion can thus be imparted because the stream of particles inside the constriction 10 and between the outer wall defining the trickling passage 10 and the cone 11 does not compactly fill the entire free volume but has a very substantial void volume and the moving particles in the stream are adequately spaced. In a compact stream, the free path lengths would be too short for an effective transverse motion of the particles. But such transverse motion having a horizontal component in the trickling passage is important for an intense mixing of hot and cold fine-grained materials. A plurality of annular and conical deflecting means may be arranged in succession.

Figure 3:
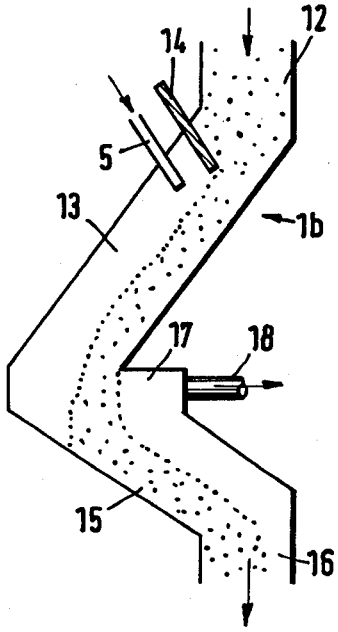
FIG. 3 is a longitudinal sectional view showing a third embodiment of a trickling passage.

FIG. 3 shows a trickling passage 1*b* which differs from the passage of FIGS. 1 and 2. The trickling passage 1*b* has a central inlet portion 12 for the hot heat-carrying solids. The central inlet portion 12 is joined at its lower end at a bend by an inclined passage portion 13. This passage portion 13 forms an angle of 30 to 70 degrees with a horizontal line. Passage portion 13 contains an adjustable metering gate valve 14 for retaining part of the approaching hot heat-carrying solids. As a result, the heat-carrying solids form a thinner, loosened stream past the gate valve 14 in a layer which has a thickness not in excess of about one-half of the cross-section of the passage. The thickness of that layer and the mass flow rate can be controlled by an adjustment of the metering gate 14.

Fine-grained devolatilizable material is fed to the heat-carrying stream through conduit 5 below the gate valve 14. As the flow rate of this devolatilizable material is much less than the flow rate of the heat-carrying solids, the free cross-section of the passage portion 13 is not completely filled by the devolatilizable material which has been added so that the granular material can slip freely under the action of gravity. The devolatilizable material is heated substantially in that region.

The passage portion 13 is connected by an abrupt bend to a lower passage portion 15, which extends at approximately right angles to the passage portion 13. The angle formed by portion 13 and portion 15 can be 60 to 120 degrees. Owing to that abrupt bend, the fine-grained material which trickles downwardly at high speed is considered agitated so that the intense mixing of hot and cold materials is adequately effected. In this region the agitation is also promoted because the fine-grained material can perform transverse movements without substantial obstructions in the free cross-section of the passage portion 15, which is sufficiently large. The vertical passage portion 16 which can form an angle of 110 to 160 degrees with portion 15, delivers the mixed fine-grained materials into the dwell zone 6, which is not shown and may be disposed in the vessel 7 as in FIG. 1. To permit overhead vapors to be withdrawn as directly as possible and without long dwell times, the lower passage portion 15 of FIG. 3 has a bulge 17, to which a withdrawing conduit 18 is connected. The mixing action can be improved in that the trickling passage **1*b* has a plurality of abrupt bends and is provided with a plurality of conduits 18** for withdrawing the product.

It will be appreciated that the trickling passage of FIG. 1 or FIG. 2 can be combined with a trickling passage having abrupt bends as shown in FIG. 3 in that such passages are connected in series. To ensure that the gaseous and varporous devolatilization products are withdrawn as quickly as possible, a purging gas can be introduced into the trickling passage from below to escape through the conduit 18 together with the volatile distillation of devolatilization products.

Figure 4:
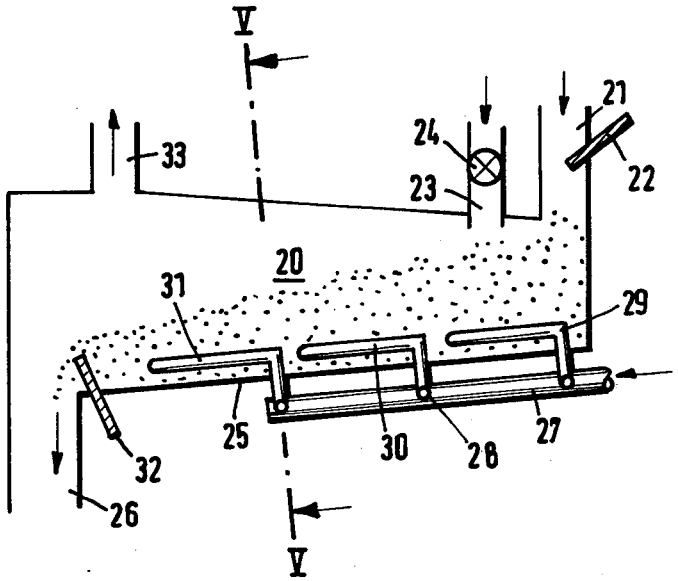
FIG. 4 is a longitudinal sectional view showing an agitating passage and FIG. 5 is a sectional view taken on line V—V in FIG. 4.
Figure 5:
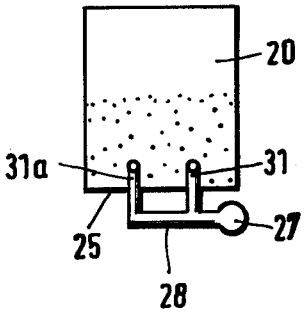

FIGS. 4 and 5 show an agitating passage for mixing heat-carrying fine-grained material and devolatilizable material and for carrying said materials to a dwell zone, not shown. The agitating chamber 20 is provided with an inlet pipe 21 for the heat-carrying solids. The inlet pipe 21 contains a metering gate valve 22. Devolatilizable fine-grained material enters through the conduit 23, which is provided with a star feeder 24 or other metering means. Under said metering means, a device, not shown, is provided, which comprises guide vanes or the like means for distributing the entering solids stream throughout the width of the passage. The bottom 25 is horizontal or slopes slightly from the receiving end to the discharge chute 26. The angle of inclination from the horizontal is suitable in the range of 0.2 to 10 degrees.

Cold or preheated agitating gas is fed to the chamber 20 from the manifold 27 through branch conduits 28 (see also FIG. 5) and nozzle conduits 29, 30, 31 and **31*a*. Conduits 31 and 31*a* in FIG. 5 indicate how the nozzle conduits consists of pairs of parallel conduits. The number of parallel nozzle conduits will depend on the width of the agitating passage and said width will depend on the required throughput rate of the solids. The nozzle conduits 29 to 31*a* comprise portions which are normally parallel to the bottom 25 and which have outlet openings for agitating gases. These outlet openings are preferably laterally directed and obliquely toward the bottom 25** so that no solids can enter the conduits even when there is no continuous purging with agitating gas. The velocity of the agitating gas leaving the openings is preferably in the range between 10 and 60 meters per second. Gas-permeable bottoms of different types, known per se, may be used instead of nozzle conduits.

During the operation of the agitating chamber 20 used as mixing and conveying means, a solids layer having only a relatively small adjusted height of about 0.1 to 1.0 meter is maintained on the bottom 25. The desired agitation of the fine-grained material and a transverse motion which is sufficient for a homogenization of the mixture can be most easily effected when the layer has a relatively low height. The height of the layer may be controlled, e.g., by an adjusting gate valve 32 near the discharge chute 26. The adjusting gate valve 32 may be replaced by a stationary weir. Whereas the fine-grained layer over the bottom 25 covers the conduits 29 to 31, it leaves sufficient free space in the chamber 20 so that the gases and vapors can flow freely to the withdrawing conduit 33.

Under certain conditions, the vertical distance from the solids inlets to the bottom 25 may influence the conveying rate in the agitating passage. For this reason, it may be desirable to provide inlet means which are adjustable in height and consist, e.g., of telescopic feed conduits.

The discharge chute 26 opens into the dwell zone, not shown, which may be contained in a vessel 7 such as is shown in FIG. 1. Such vessel may not be provided with a separating withdrawing conduit for evolved vapors because these vapors rise through the chute 26 countercurrently to the solids trickling down and then enter the chamber 20 and can be withdrawn through conduit 33.

The residence time of the devolatilizable material in the chamber 20 is not critical and may be between about 2 and 40 seconds. When a sufficient mixing with the hot heat-carrying solids has been effected even after a fraction of the entire dwell time, this means that the desired evolution of gases and vapors from the devolatilizable material is substantially effected in the agitating passage.

It is desired to minimize the ratio of the agitating gas used in the agitating chamber 20 because such agitating gas will be contained in the product which is withdrawn through the conduit 33 and the agitating gas adds to the load on the succeeding gas-cooling and condensing equipment. For this reason it is within the scope of the invention to divide the agitating passage into a plurality of longitudinally running zones in case of need and to supply said zones with agitating gas at different rates per unit of length.

FIG. 4 shows by way of example a division into three zones, which are associated with three pairs of nozzle conduits 29, 30 and 31, **31*a***. The first zone near the inlet for the material is suitably fed with gas at a relatively high rate so that the higher velocity of the agitating gas will result in a more intense motion of the particles and in a rapid mixing. The middle zone is preferably supplied with gas at a lower rate, which is just sufficient to ensure a conveyance of the material in the longitudinal direction. Somewhat higher velocities than in the middle zone, are maintained in the third zone so that the flow and a uniform discharge are ensured. The velocities will depend mainly on the particle size of the materials to be mixed. The velocity in the mixing zone provided near the inlet is preferably 1.3 to 6 times the fluidizing point velocity.

The several zones may differ in length. According to a preferred further feature of the invention the agitating gas is introduced into the agitating passage at a rapidly fluctuating rate. To save agitating gas, its supply may be pulsating, i.e., interrupted for short times, preferably in the zones which follow the mixing zone.

EXAMPLE 1

A system as shown in FIG. 1 was operated as follows:

Heat devolatilized residue used as a heat-carrying material at a temperature of 780° C. was supplied to the trickling passage 1 at a rate of 360 metric tons per hour. The inlet passage leading to the trickling passage was 0.7 meter in diameter and the heat-carrying solids had a particle size from 0 to 4 mm. The trickling passage 1 was 1.6 meters in diameter. Devolatilizable material consisting of predried lignite was injected at a velocity of 25 meters per second and at a rate of 8 metric tons per hour through each of four conduits 5 into the stream of heat-carrying material which had been loosened up by the distributing zone 2. The particle size of the devolatilizable material was in the range from 0 to 5 mm. The injection was effected with the aid of an entraining gas consisting of inert gas or of recycled overhead gas evolved in the same process. The cylindrical portion of the vessel 7 had a height of 6 meters and was 3.8 meters in diameter. The dwell zone 6 consisting of the pile of solids in 7 had a height of 3.6 meters. This height was maintained substantially constant by a continuous withdrawal of fine-grained solids from the vessel. Hydrocarbon-containing gases and vapors at a rate of 50,000 standard $m^3$ per hour were withdrawn through conduit 8 and fed to a condenser. The temperature in the dwell zone 6 was about 700° C.

EXAMPLE 2

The mixer-conveyor consisted of an agitating passage such as is shown in FIGS. 4 and 5. It was fed at a rate of 150 metric tons per hour with tar sand, which had been reduced to a particle size of about 0 to 10 mm and contained inorganic material having a particle size of 0 to 2 mm. At the same time, heat-carrying material at a temperature of 650° C. was supplied to the agitating passage at a rate of 750 metric tons per hour. The heat-carrying material consisted of devolitilized tar sand and had also a particle size of 0 to 2 mm. The materials were supplied in such a manner that part of the heat-carrying material was supplied first, then the tar sand and thereafter the remainder of the heat-carrying material so that the tar sand was disposed between two layers of the heat-carrying material.

The agitating passage had a length of 5 meters and a width of 3 meters. Its bottom 25 was inclined 3° from the horizontal. The agitating passage was provided at its outlet end with a stationary weir 100 mm high. The agitating gas was supplied through 30 nozzle conduits, which extended in parallel. The agitating gas consisted of cold overhead gas, which was recycled to the agitating passage from the end of a condenser that succeeded the devolatilizing unit.

By agitating gas introduced at the rate of 10,000 standard $m^3$ per hour, the heat-carrying material and tar sand were agitated and rapidly mixed. The resulting mixture had a temperature of 510° C., at which the organic content of the tar sand is substantially completely vaporized and can leave the agitating passage through the conduit 33 in the form of oil vapor and cracked gas in a mixture with the agitating gas and evaporated moisture. The heat-carrying material in a mixture with the newly formed residue, which contains some carbon, leaves the agitating passage through the discharge chute 26.

Generally speaking, the loosened stream of moving solids in the mixing passages of FIGS. 1 to 2 has a bulk density of up to 20 percent of the static bulk density in the dwell zone below these passages. In all embodiments of the process the heated solids can have a particle size of up to 10 mm although they are preferably in the range of up to 6 mm. On the other hand, the fine-grained material has about the same particle size, generally speaking. Although various materials can be used as heated solids for the purpose of devolatization in accordance with this invention, it is preferred that these heated solids be the residue obtained by the devolatilization of the devolatilizable fine grained material like tar sand, oil shale, oil-containing diatomaceous earth and coal.

What is claimed is:

1. An apparatus for devolatilizing hydrocarbon-containing fine-grained material selected from the group consisting of tar sand, oil shale, oil-containing diatomaceous earth and coal, comprising an agitating chamber with a bottom, at least one feed conduit for feeding said fine-grained material into said chamber, at least one inlet pipe for feeding fine-grained heated solids at a temperature of about 500° to 1000° C. into said chamber to form a mixture of solids therein, thereby heating said fine-grained material to temperatures of about 400° to 900° C. and devolatilizing it, said chamber having a withdrawing conduit for gases and vapors, said bottom having a discharge chute connected to a dwell zone for said mixture of solids, said bottom being horizontal or sloping slightly to the discharge chute, said agitating chamber being provided with a means for introducing agitating gas into said chamber to agitate said mixture of solids, the mixture of solids in the agitated state in said chamber caused by said agitating gas being moved towards said discharge chute and having a height of 0.1 to 1.0 meter, said introducing means comprising a manifold for feeding said agitating gas into the chamber disposed below the bottom of said chamber, branch conduits connected to said manifold, and nozzle conduits connected to said branch conduits, said nozzle conduits being parallel to and above said bottom, said nozzle conduits having nozzle openings obliquely directed toward said bottom.

2. Apparatus according to claim 1, wherein the chamber comprises an adjustable weir near the discharge chute.

3. Apparatus according to claim 1, wherein the feed conduit is adjustable in height.

4. Apparatus according to claim 1 wherein the inlet pipe is adjustable in height.

5. Apparatus according to claim 1, wherein downstream of the discharge chute a trickling passage is connected to the apparatus, said passage containing at least one obstacle to the flow of solids.

6. Apparatus according to claim 1, wherein downstream of the discharge chute a trickling passage is connected to the apparatus, said passage containing an abrupt bend.

7. Apparatus according to claim 1, wherein upstream of the feed conduit a trickling passage is connected with said apparatus, said passage being connected to a source of the fine-grained material and the heated solids.

8. Apparatus according to claim 1, wherein said nozzle conduits are disposed in a plurality of longitudinally different zones, said introducing means being arranged and constructed to introduce said agitating gas into said chamber at different velocities in said different zones such that in a first zone next to said feed conduit agitating gas is introduced into said chamber at a higher velocity than in a second zone following said first zone in a direction toward said discharge chute and the velocity of agitating gas in a zone next to the discharge chute being higher than in the preceding zone.

* * * * *